US005352292A

United States Patent [19]

Thomas

[11] Patent Number: 5,352,292

[45] Date of Patent: Oct. 4, 1994

[54] APPARATUS FOR COATING EXTERIOR WELD JOINTS OF A PIPE

[75] Inventor: Samuel J. Thomas, Lowel, Mass.

[73] Assignee: The Kendall Company, Mansfield, Mass.

[21] Appl. No.: 351

[22] Filed: Jan. 4, 1993

[51] Int. Cl.[5] ..... B05C 5/00

[52] U.S. Cl. ..... 118/669; 118/683; 118/684; 118/305; 118/315; 118/DIG. 11

[58] Field of Search ..... 118/668–670, 118/683, 684, 305, 315, DIG. 11

[56] References Cited

U.S. PATENT DOCUMENTS

| | | | |
|---|---|---|---|
| 2,175,392 | 10/1939 | Henry | 118/DIG. 11 |
| 2,488,519 | 11/1949 | Andrews et al. | 118/684 |
| 2,535,451 | 12/1950 | Phillips | 118/DIG. 11 |
| 4,953,496 | 9/1990 | Taylor et al. | 118/DIG. 11 |
| 5,203,923 | 4/1993 | Hartman | 118/669 |

FOREIGN PATENT DOCUMENTS

| | | | |
|---|---|---|---|
| 2035148 | 6/1980 | United Kingdom | 118/669 |

*Primary Examiner*—Matthew O. Savage
*Attorney, Agent, or Firm*—Alvin Isaacs

[57] ABSTRACT

An external pipe covering apparatus is provided for coating exterior surfaces of uncoated longitudinal, helical and girth weld joints of a pipe to provide protection against corrosion, to minimize the weld projection by filling in any voids on either side of a weld, and to further provide a uniform smooth surface for a later applied tape. The apparatus is moved along a pipe by a crane or similar mechanical device. The apparatus has a carriage to which is attached wheels, a reservoir attached to the upper frame of the carriage for holding liquid resin, a circular member having at least one sensor therein attached to the lower frame of the carriage, a microprocessor attached to the upper frame of the carriage, a circular dispenser for dispensing liquid resin having at least one nozzle and at least one solenoid valve attached to the lower frame of the carriage for dispensing resin from the reservoir, and a pump for delivery of liquid resin to the nozzle. In operation, a sensor or sensors send electrical signals to a microprocessor, which then sends an electrical signal or signals, depending on the type of weld joint sensed, simultaneously to a corresponding solenoid valve or valves and a positive displacement pump. The pump when activated pumps liquid resin to a nozzle(s) through the activated and open solenoid valve(s). The resin is then sprayed by the nozzles onto the weld joint area.

2 Claims, 2 Drawing Sheets

APPARATUS FOR COATING EXTERIOR WELD JOINTS OF A PIPE

FIELD OF INVENTION

This invention relates to pipe coating, and more particularly, to an apparatus for coating longitudinal, helical and girth welds with a resin so as to protect the welds from corrosion, to minimize weld projections by filling voids on either side of a weld, and further provide a uniform smooth surface for a later applied tape.

PRIOR ART

It is well known in the prior art to coat pipes with a protective coating when pipes are installed underground. It is also well known that pipes to be installed underground have to have their weld joints covered to prevent corrosion of the pipe at the weld joints by moisture or other corrosive-inducting elements.

In U.S. Pat. No. 4,287,223 there is described a steel pipe with a thermoplastic cover having a welding seam being reinforced by hot air heating of the plastic cover and extruding a strip of similar plastic thereon. This is followed by cold water spray cooling. The pipe is centered with respect to the position of the welding seam visa-vis the heating and extruding equipment during relative longitudinal movement.

In U.S. Pat. No. 4,038,940 there is described a system for spraying circumferentially around a pipe comprising a yoke engagable with the pipe for more than 180° of the pipe. The yoke has a powder dispenser mounted thereon. The yoke is driven circumferentially about the pipe. The system also includes a powder suspension device and a blower-suction device providing a stream of air under pressure to the powder suspension device for creating an air-powder suspension therein. The powder dispenser has openings adjacent the surface of the pipe and accurately shaped to conform with the curvature of the pipe. A spray or stream of the air-powder suspension is delivered to the surface of the pipe. An other conduit connects with the outer hosing of the powder dispenser and the suction inlet of the blower suction device to suck excess powder from the weld joint and return it to the system.

In U.S. Pat. No. 4,670,301 there is described a method and apparatus for coating a helical weld seam extending around a spirally welded pipe. Following the application of the usual coating as by a sintered polyethylene coating process, the heated pipe is subjected to a further flow of the coating material from a hopper on a movable coating apparatus, so to coat the weld seam of the pipe. The heat of the pipe melts the applied powder over the weld seam resulting in an increased increment of coating thickness at the weld.

In U.S. Pat. No. 4,092,950 there is described an internal pipe coating apparatus for coating the interior surface of uncoated weld joints by spraying powder on an uncoated weld joint, which has been previously heated in a conventional manner. The weld joints are found by a feeler mechanism.

In U.S. Pat. No. 3,625,259 there is described a protective cover for an underground conduit having a raised weld. The cover consists of a relatively hard corrosion-resistant pre-coating applied over the weld and an elongated protective strip wrapped around the conduit, with or without a primary coating under the strip.

In U.S. Pat. No. 4,780,158 there is described a method of heat-shrinking pipe wrap throughout the periphery of the pipe wrap surface and the apparatus used to heat-shrink the pipe wrap, thus covering the surface of a pipe with a plastic sheet.

In the aforementioned prior art there is described: the coating of the exterior of pipes by spraying of powder onto a heated weld joint; the applying to a pipe that has a thermoplastic cover an extruded similar plastic thereon after heating the cover; the application of a sintered polyethylene coating to a preheated pipe to increase the coating thickness in the region of the weld; the coating of the interior of a pipe by spraying powder on a heated uncoated weld joint to make a continuous coating on the interior of the pipe, the weld areas being located by feeler arms acting as electrical conductive arms which complete a circuit when the feeler arms engage an uncoated region of a pipe causing the pipe to be spray coated; wrapping a pipe with a heat-shrink pipe wrap to protect the pipe; and finally, prior art that describes a protective coating but does not mention nor suggest an apparatus to apply it.

None of the aforementioned art provides an apparatus such as the present invention. The present invention far surpasses the prior art by advancing the art of the coating of pipes by sensing welds, whether longitudinal, helical or girth, and then spraying a liquid resin onto the welds to provide protection from corrosion; to minimize the weld projection by filling in voids on either side of a weld and to provide a smooth even surface for a later applied tape.

SUMMARY OF THE INVENTION

An external pipe covering apparatus for coating exterior surfaces of uncoated longitudinal, helical and girth weld joints of a pipe to provide protection from corrosion, minimize the weld projection by filling in any voids on either side of a weld, and to further provide a uniform smooth surface for a later applied tape. The apparatus has a carriage to which wheels are attached at its forward and rear ends, a reservoir located a the rear of the upper frame of the carriage, a means for sensing welds, a means for dispensing resin from the reservoir, and a positive displacement pump. When the sensing means locates a weld, it send a signal simultaneously to the pump and dispenser to activate them so that the dispenser may deposit resin through nozzle(s) onto a weld area.

It is an object of the present invention to provide an apparatus to sense an uncoated weld and then to dispense a liquid resin onto that weld to provide coverage of a weld seam so as to provide adequate corrosion protection, to minimize the weld projection by filling in voids on either side of a weld and to provide a smooth even surface for a later applied tape.

It is a further object of this invention to provide liquid resin coverage to uncoated longitudinal, helical and girth welds.

The preferred embodiment of the present invention and objects will be better understood from the following description taken in connection with the accompanying drawings.

DETAILED DESCRIPTION OF THE INVENTION

Figure 1:
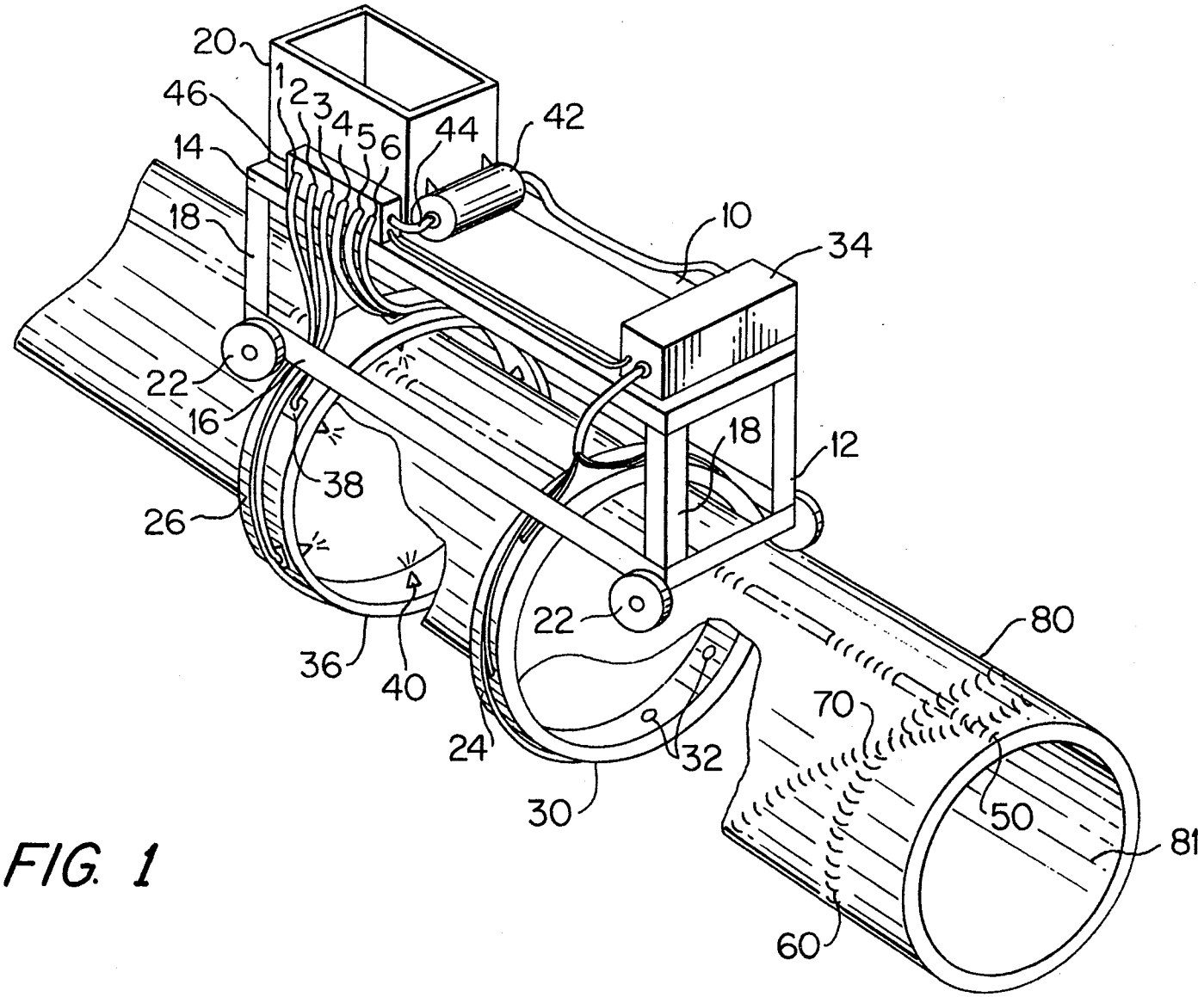
FIG. 1 is a perspective view illustrating the novel apparatus of this invention positioned on a pipe.

In FIG. 1, the apparatus 10 is shown to be made up of a carriage 12, having an upper 14 and lower 16 frame connected by side members 18. Attached to the upper frame 14 is a reservoir 20 for storage of liquid resin. The lower frame 16 has rotatably mounted wheels 22 located at the front and rear of the lower frame. The wheels 22, as illustrated in FIG. 1, are contactable with the outer surface of pipe 80 and moveable thereon. Also attached to the lower frame 16 is a means for sensing 24 weld joints and a means for dispensing liquid resin 26. The upper 14 and lower 16 flames and the side members 18 of the carriage 10 may be made from any standard materials such as steel, aluminum or other similar materials having adequate strength. The reservoir 20 for holding resin may also be made from steel or aluminum, but preferably from stainless steel. The wheels 22 located on the lower frame 16 are made from steel and are standard items purchaseable from manufacturer's of such wheels.

Figure 2:
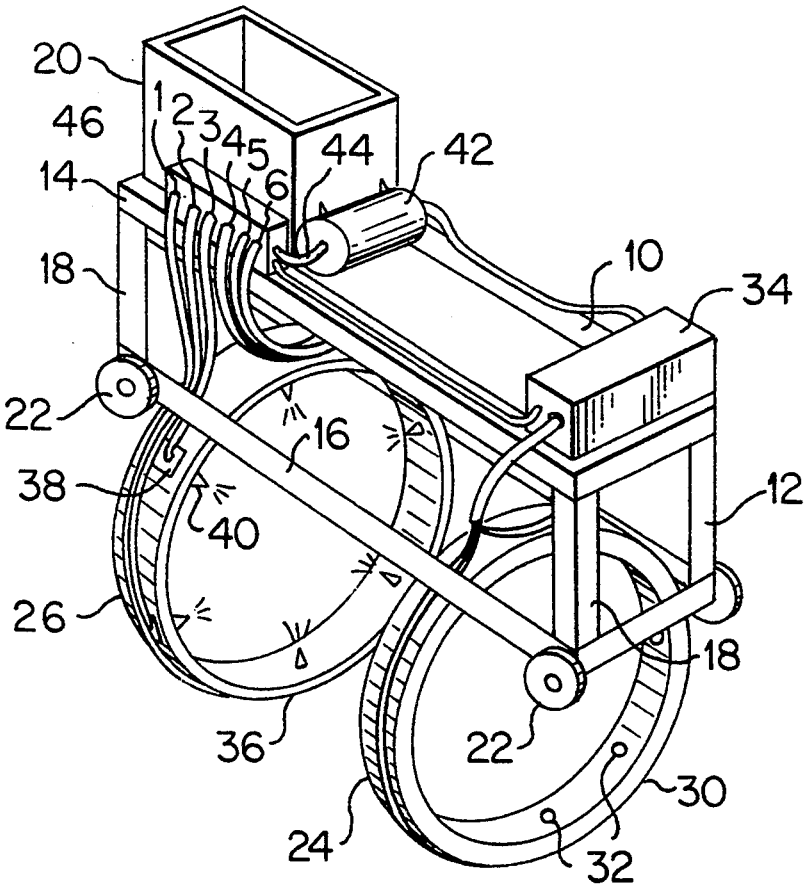
FIG. 2 is a perspective view illustrating the novel apparatus of this invention.
Figure 4:
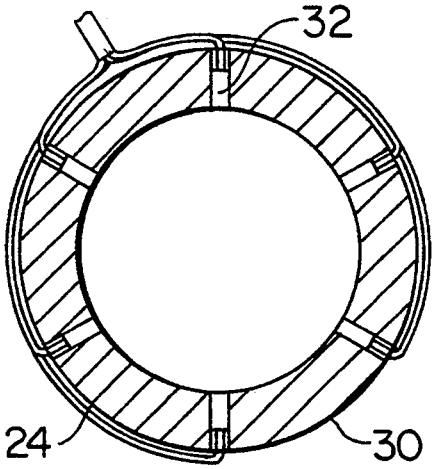
FIG. 4 is a cross-sectional view of the means for sensing weld joints.

Turning to FIG. 2, the apparatus is illustrated before it is placed on a pipe. Referencing FIG. 4, the means for sensing welds 24, includes a circular member 30, and as shown in FIG. 1, is attached to the lower frame 16 of the carriage 12. The circular member 30 has at least one sensor 32 for locating welds to be coated. The member 30 is located at the forward end of the lower frame 16 between the forward and rear wheels 22. The sensor 32 may be any known electronic sensing means such as an electronic eye or a laser detecting sensor. In association with the sensor 32, there is electrically connected a microprocessor 34 capable of being programmed to receive signals from sensor 32 regarding locations of welds 50, 60, and 70, as shown in FIG. 1. Once the sensor 32 finds a weld joint, it sends an electrical signal to the microprocessor 34 which then sends a further electrical signal to simultaneously activate a positive displacement pump 42 and at least one solenoid valve 38, which controls at least one nozzle 40 located in the dispenser 26. Given the numerous available microprocessor's on the market, a person skilled in the art could readily select a suitable microprocessor.

Figure 3:
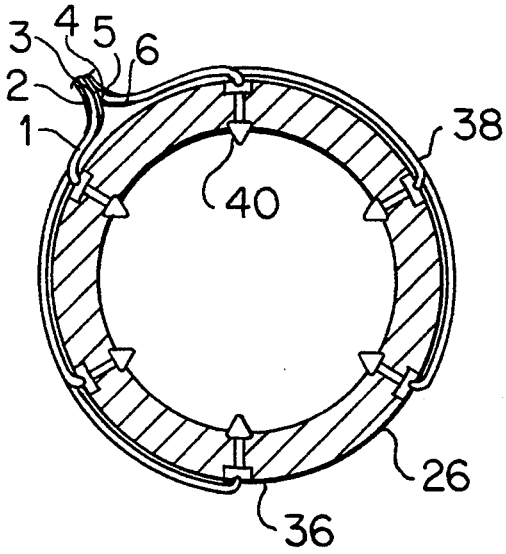
FIG. 3 is a cross-sectional view of the means for dispensing resin.

As shown in FIG. 3, the means for dispensing liquid resin 26 from a reservoir 20 to coat a weld located by a sensor 32, includes a circular dispenser 36, which as shown in FIG. 1, is attached to the lower frame 16 of the carriage 12 and preceded by the sensing means 24. The dispenser 36 has at least one nozzle 40 and at least one solenoid valve 38 connected to each nozzle 40. The solenoid valve distributes the liquid resin from the reservoir 20 to the nozzle 40 to coat welds located by the sensor 32. The dispense 36 is located to the rear of the lower frame 16 behind and in close proximity to sensing means 24 and between the forward and rear wheels 22. The dispenser 36 is also located beneath the reservoir 20 from which the resin is supplied to the dispenser 36. When a weld is located by the sensor 32, the liquid resin is pumped from the reservoir 20 by the positive displacement pump 42. The resin then flows through flexible hose 44 to holding chamber 46 from which the liquid resin is delivered through at least flexible hoses 1, 2, 3, 4, 5 and 6 to solenoid valve(s) 38 then to nozzle(s) 40. The solenoid valve 38 controls the amount of liquid resin delivered to the nozzle 40 and thereafter sprayed onto a weld joint of a pipe.

The reservoir 20 positioned on the upper frame 14 is a conventional reservoir used to contain liquid resin for delivery by pump 42 to dispenser 36.

In operation, as shown in FIG. 1, the coating apparatus 10 is positioned onto the surface of a pipe 80 being placed in the ground. The placement of the apparatus 10 may be accomplished by a crane or other similar mechanical means. When the apparatus 10 is in place, the wheels 22 rotatably mounted on the lower frame 14 contact the surface of the pipe 80 for moveability of the apparatus by a crane. The crane moves the apparatus 10 in the direction of the open end 81 of the pipe 80. As the apparatus 10 is moved, the sensing means 24 with the sensor(s) 32 therein detect a weld joint such as longitudinal weld 50, girth weld 60 or helical weld 70, as illustrated in FIG. 1. When the sensor(s) 32 detect a weld joint an electrical signal is sent by the sensor to a microprocessor 34 which simultaneously sends an electrical signal to a positive pressure pump 42 connectable with the reservoir 20 and to solenoid valve(s) 38 connectable with nozzles 40. Each sensor 32 is electrically connected through a microprocessor 34 to a solenoid valve 38 (the electrical connections from the microprocessor to the solenoid valve(s) are not shown in the Fig's.) Solenoid valve 38 is connected to a nozzle 40. both the solenoid valve 38 and nozzle 40 are in the same corresponding position on circular member 36 of the dispensing means 26 as the sensor 32 is on the circular member 30 of sensing means 24. Therefore, when the sensor 32 locates a weld, the corresponding nozzle 40 activated by that sensor 32 is in the same line or position as that sensor and will spray liquid resin in the area determined by that sensor. Additionally, each sensor is electrically connected through the microprocessor 34 to a positive displacement pump 42 which drawn liquid resin from the reservoir 20. Because the sensor(s) 32, the solenoid valve(s) 38 and the positive displacement pump 42 are electrically interconnected through the microprocessor 34, the signal sent by the sensor(s) 32 and received from the microprocessor 34 simultaneously activates the pump 42 and solenoid valve(s) 38. Once activated, the pump 42 draws liquid resin from the reservoir 20 and pumps it, depending on what type of weld joint is sensed, through either a single solenoid valve 38 and its corresponding nozzle 40 or to a plurality of solenoid valves 38 and their corresponding nozzles 40 in the dispenser 36. As the liquid resin is pumped into the dispenser 36, the resin passes through an appropriately opened solenoid valve 38, and a corresponding nozzle 40 and is sprayed onto a weld joint. The sensor or sensors 32, through the microprocessor 34, may activate an individual solenoid valve 38 and nozzle 40 or a series of solenoid valves 38 and nozzles 40, depending on the type of weld that is located. For example, in FIG. 1, if a longitudinal weld 50 is located, the sensor 32 sends one signal to the microprocessor 34 which activates the corresponding solenoid valve 38 permitting liquid resin to flow into its corresponding nozzle 40 and spray liquid resin onto the longitudinal weld 50 thereby filling any voids on either side of the weld 50. Or if a girth weld 60 is located, all the sensors 32 would send signals to the microprocessor 34 which would then activate all the solenoid valves 38 permitting liquid resin to flow to all the nozzles 40 so as to spray resin circumferentially around the pipe 80 thereby filling any voids on either side of the girth weld joint 60.

It should be noted that the liquid resin is sprayed to cover an area on each side of the weld joint so as to fill any voids that may be present. More importantly, the liquid resin provides protection from corrosive elements when the pipe is placed in the ground. Furthermore, the filling of the voids along the weld joints with resin provides a smooth even surface for the future addition of a pipe tape.

It should be understood that an external electrical power source is used to power the solenoid valve(s), positive displacement pump and the sensor(s). The external power source is not shown nor is it discussed in this application.

It should be further understood that the solenoid valve(s) and positive displacement pump are standard items and purchaseable from any suitable supplier of such items.

Whereas, the present invention has been described in particular relation to the drawings attached hereto, it should be understood that other and further modifications of the invention, apart from those shown or suggested herein may be made within the spirit and scope of this invention.

What is claimed is:

1. Apparatus for coating exterior surfaces of uncoated longitudinal, helical and girth weld joints of a pipe, the apparatus being movable along a pipe's surface by a crane or other similar mechanical device, comprising:

a carriage having opposed first and second frame members, and opposed leading and trailing ends with respect to the direction of movement of the device along the pipe's surface;

the first frame member of the carriage having wheels rotatably mounted to the first frame member at the leading and trailing ends of the carriage, the wheels being contactable with the outer surface of the pipe;

a reservoir for storage of liquid resin for coating the pipe surface secured to a frame member of the carriage;

opposed side members connecting the opposed first and second frame members together;

sensing means attached to the first frame member for sensing the presence of longitudinal, helical or girth weld joints on the pipe surface, the sensing means including a circular sensor member secured to the first frame member and having at least one sensor for locating a weld to be coated, the circular member being located at the leading end of the first frame member;

dispensing means for dispensing liquid resin from the reservoir to coat welds sensed and thereby located by the sensing means, the dispensing means being attached to the first frame member between the sensing means and the trailing end of the carriage whereby the sensing means determines the presence of a weld in advance of the dispensing means as the carriage is advanced along the pipe surface;

means for delivering liquid resin from the reservoir to the dispensing means;

microprocessor means for transmitting an electrical signal when the sensing means senses the presence of a weld on the pipe surface; and means for transmitting the signal from the microprocessor means simultaneously to both the means for delivering liquid resin from the reservoir and to the dispensing means, thereby actuating the dispensing means on signal for coating the weld as the carriage moves along the pipe surface.

2. Apparatus as defined in claim 1 wherein the dispensing means for dispensing liquid resin includes a circular dispenser member having at least one nozzle for dispensing liquid resin from the reservoir to coat welds located by the sensor;

hose means for delivering resin from the reservoir to the nozzle(s); and valve means connected to each nozzle for controlling the amount of liquid resin dispensed through each nozzle.

* * * * *